United States Patent [19]

Arana Erana

[11] 4,436,141

[45] Mar. 13, 1984

[54] MOLDING SAND BLOWERS

[76] Inventor: Agustin Arana Erana, Zorrostea, 4 Poligono Industrial Ali-Gobeo, Victoria, Spain

[21] Appl. No.: 235,732

[22] Filed: Feb. 18, 1981

[30] Foreign Application Priority Data

Feb. 20, 1980 [ES] Spain ..... 488791
Apr. 9, 1980 [ES] Spain ..... 249912[U]

[51] Int. Cl.[3] ..... B22C 15/22
[52] U.S. Cl. ..... 164/201
[58] Field of Search ..... 164/12, 16, 22, 29, 164/200, 201, 202

[56] References Cited

U.S. PATENT DOCUMENTS

| | | | |
|---|---|---|---|
| 2,789,325 | 4/1957 | McKee | 164/202 |
| 3,528,481 | 9/1970 | Lund | 164/16 X |
| 3,556,195 | 1/1971 | Lund | 164/16 |
| 3,581,801 | 6/1971 | Hulslander | 164/22 |
| 3,610,322 | 10/1971 | Schoffmann | 164/443 |
| 3,899,019 | 8/1975 | Langne | 164/201 |
| 4,171,720 | 10/1979 | Strub | 164/202 X |

FOREIGN PATENT DOCUMENTS

| | | | |
|---|---|---|---|
| 1075776 | 3/1953 | France | 164/201 |
| 55-156640 | 12/1980 | Japan | 164/200 |

*Primary Examiner*—Gus T. Hampilos
*Assistant Examiner*—Jerold L. Johnson
*Attorney, Agent, or Firm*—Wenderoth, Lind & Ponack

[57] ABSTRACT

A blowing sand molding machine includes a main frame to the top of which is mounted a hopper for storing sand, which hopper, at a given moment, is vertically aligned with a corresponding blowing cartridge which receives a portion of the sand so that by means of a current of pressurized air blown into the cartridge the sand passes therefrom to master plates fixed to appropriate supports. Longitudinally disposed on the main frame and below the blowing cartirdge, a pair of cylindrical bars acting as guides for the supports of the master plates, the bars or guides extending along the front and rear zones of the machine. The bar of the front zone occupies a substantially lower plane than that occupied by the bar of the rear zone. One master plate support is moved along the guides by means of a manually operated wheel, while the other support is moved along such guides with the help of a pressure cylinder. Between the outlet of the blowing cartridge and the master plates there is installed a gassing plate displaceable horizontally and alternatively by another pressure cylinder. Between the pressurized air duct and the blowing cartridge there is arranged a sealed coupling device flexible in a vertical direction.

2 Claims, 7 Drawing Figures

MOLDING SAND BLOWERS

BACKGROUND OF THE INVENTION

The present invention relates to improvements in blowing sand molding machines.

The improvements here described are included in that type of machine which includes a frame to the upper part of which is supported a hopper wherein molding sand is stored.

The hopper is, at a given moment, in vertical alignment with a blowing cartridge which receives a portion of the said which, immediately and by means of a current of air under pressure blown into the interior of the cartridge, passes to corresponding master or pattern plates fixed to corresponding supports.

One object of the present invention is to provide an improved assembly of and structure for the supports for the master plates.

Another object of the invention is to provide an improved structure for and functioning of a gassing plate included in the molding sand blower.

A further object of the invention is to provide an improved device which permits air under pressure to enter the interior of the blowing cartridge.

The first object is achieved by longitudinally disposing on the frame of the machine and in a plane immediately below the blowing cartridge, a pair of cylindrical bars which act as guides for the supports of the master plates. These bars or guides extend along the front and rear zones of the frame of the machine, the bar of the front zone occupying a plane which is substantially lower than that occupied by the bar of the rear zone. With this arrangement, the front bar does not constitute an obstacle for the operator of the machine.

The supports of the master plates slide along the bars or guides through two different means: one consisting in manually driving one of the supports by means of controlling a wheel, and the other consisting in automatically driving the other support by means of a pressure cylinder.

The automatically driven support is formed of two halves. The rear half is guided on the cylindrical bars and the front half is hinged to the rear half and joind to the stem of another pressure cylinder which causes the front half to pivot in order to deposit a produced mould on a conveyor belt.

The second object of the invention is achieved by placing the gassing plate on arms which hang from rails located at opposite sides of the blowing cartridge. These arms incorporate wheels which slide along the rails driven by a pressure cylinder. Under these conditions, the gassing plate is capable of alternatively moving within a horizontal plane to be located in the vertical plane of the master plates or to be withdrawn therefrom when the gassing of the sand stored in the plates has taken place.

The third object of the invention involves preventing drawbacks present in conventional sand blowers with respect to the couplings between the pressurized air duct and the blowing cartridge. In these conventional machines, such coupling is a complicated assembly of ducts wherein the air looses pressure and, consequently, its action on the sand is weakened.

With the device of the invention, the tightness necessary between the pressurized air duct and the blowing cartridge is maintained constant, in spite of movements to be made by the cartridge.

In general terms, such device of the invention includes a nozzle which is tightly coupled to an inlet formed sideways in the blowing cartridge which receives the sand from the feed hopper. In one position of the blowing cartridge, the nozzle is in alignment with a block member to which a flexible pipe, through which the pressurized air passes to the interior of the cartridge, is connected. The block member is mounted on a vertically disposed guide along which it is capable of being moved downwardly by the blowing cartridge when the same descends to be tightly coupled to a core box formed by the plates. The block member is returned to its original position by a spring when the nozzle leaves the block member at a time at which the blowing cartridge is again directed to the hopper to collect a new load of sand.

BRIEF DESCRIPTION OF THE DRAWINGS

In order to explain with more detail the characteristics of the blowing sand molding machine according to the present invention, reference is made to the following description, taken with the accompanying drawings, wherein.

DETAILED DESCRIPTION OF THE INVENTION

Figure 1:
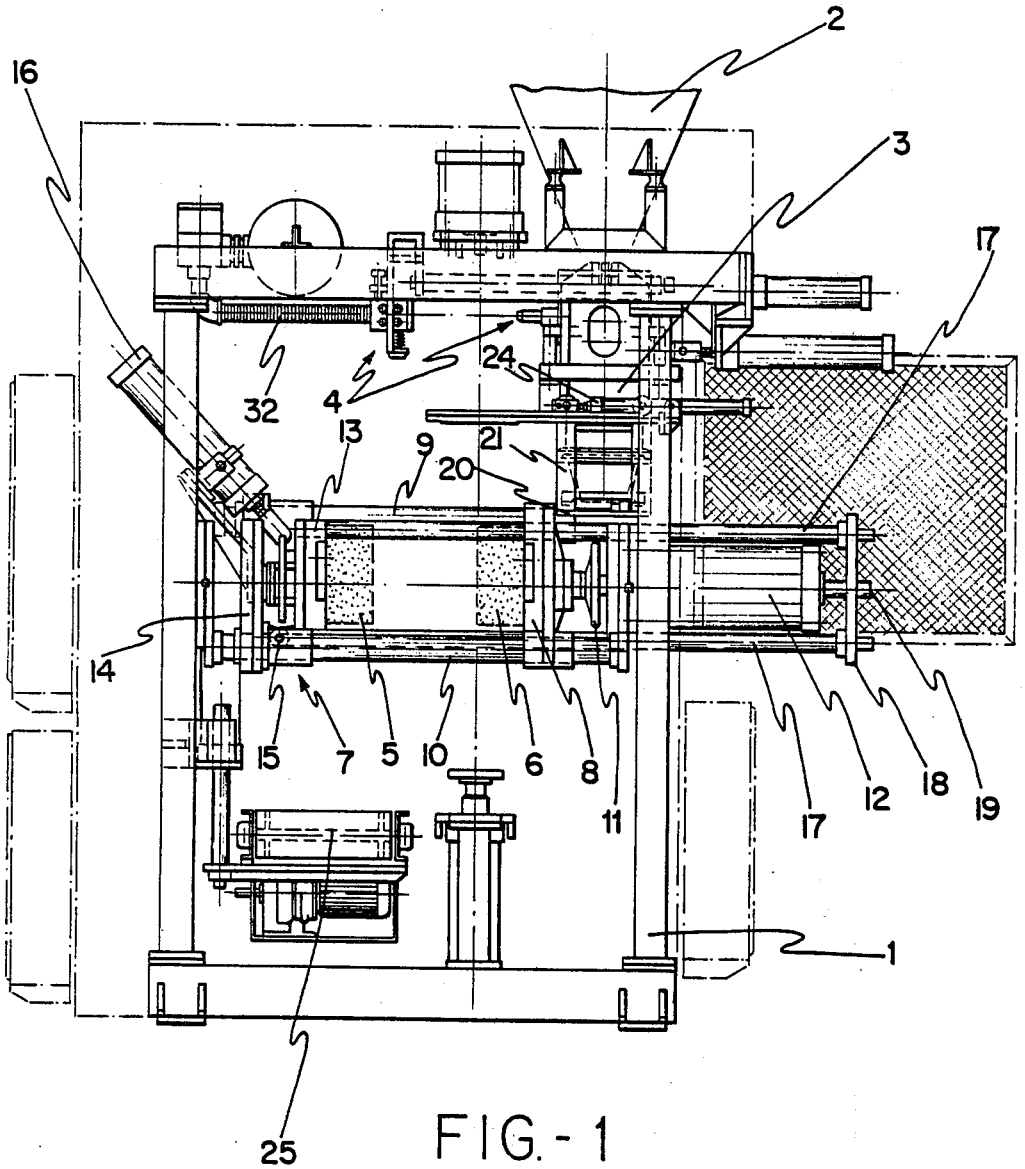
FIG. 1 is a front elevational view of a blowing sand molding machine incorporating the improvements of the invention.
Figure 2:
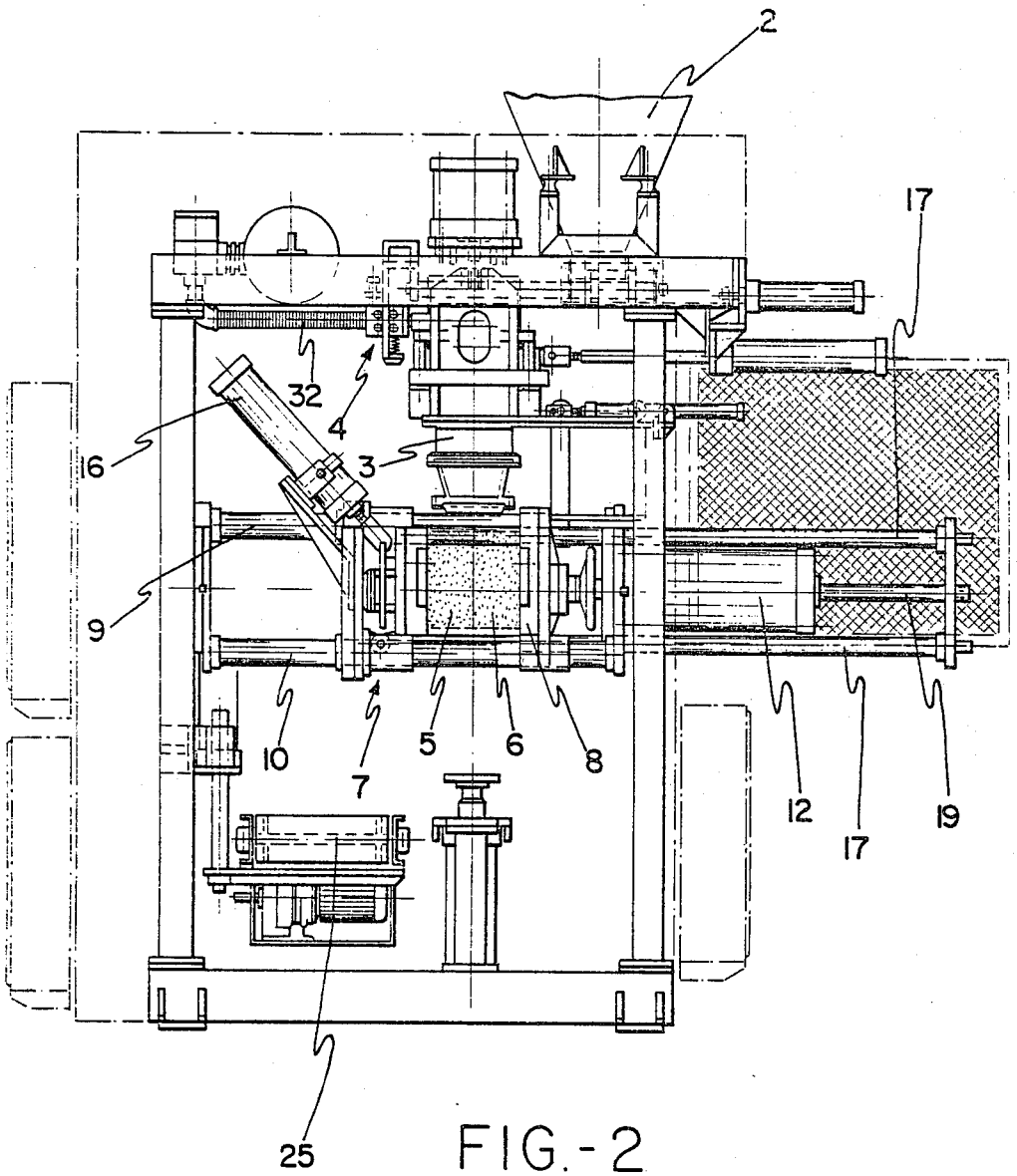
FIG. 2 is a view similar to FIG. 1, but wherein the movable elements thereof are shown in another position.
Figure 3:
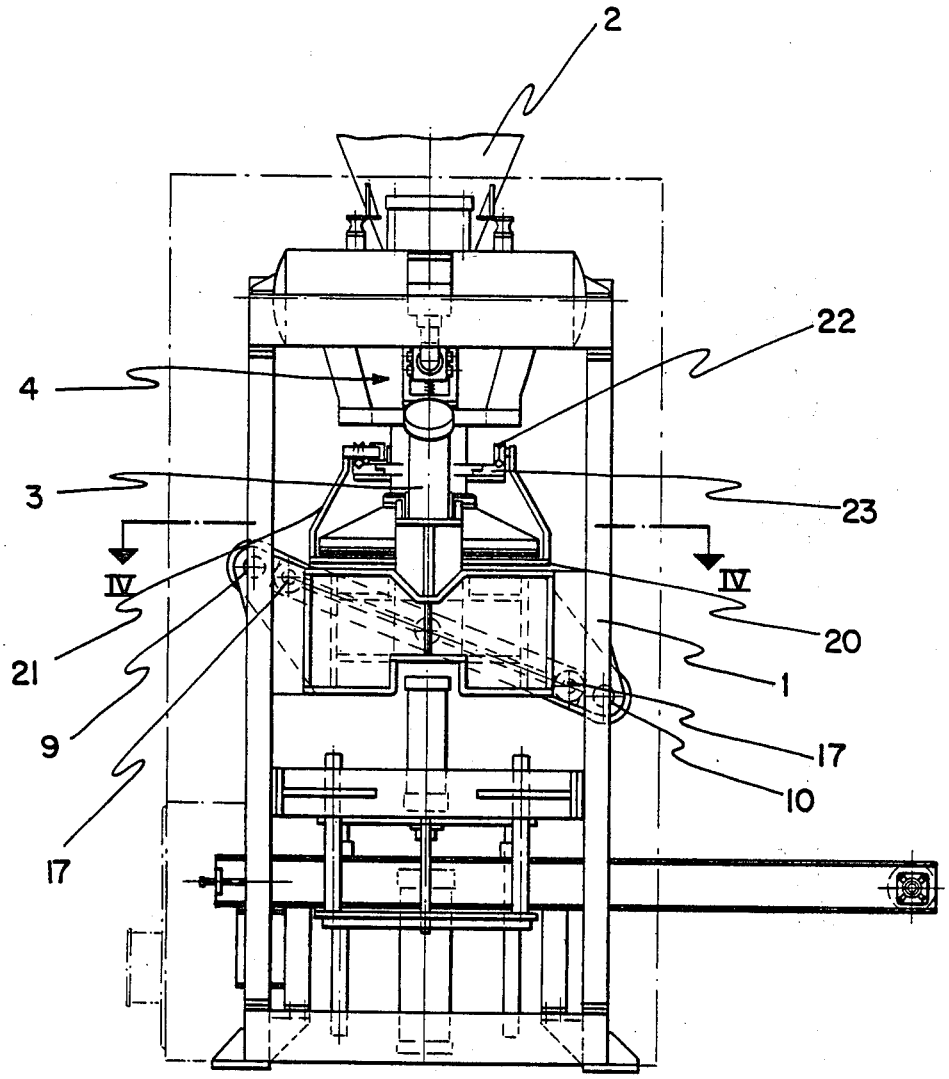
FIG. 3 is a side elevational view of the machine.
Figure 4:
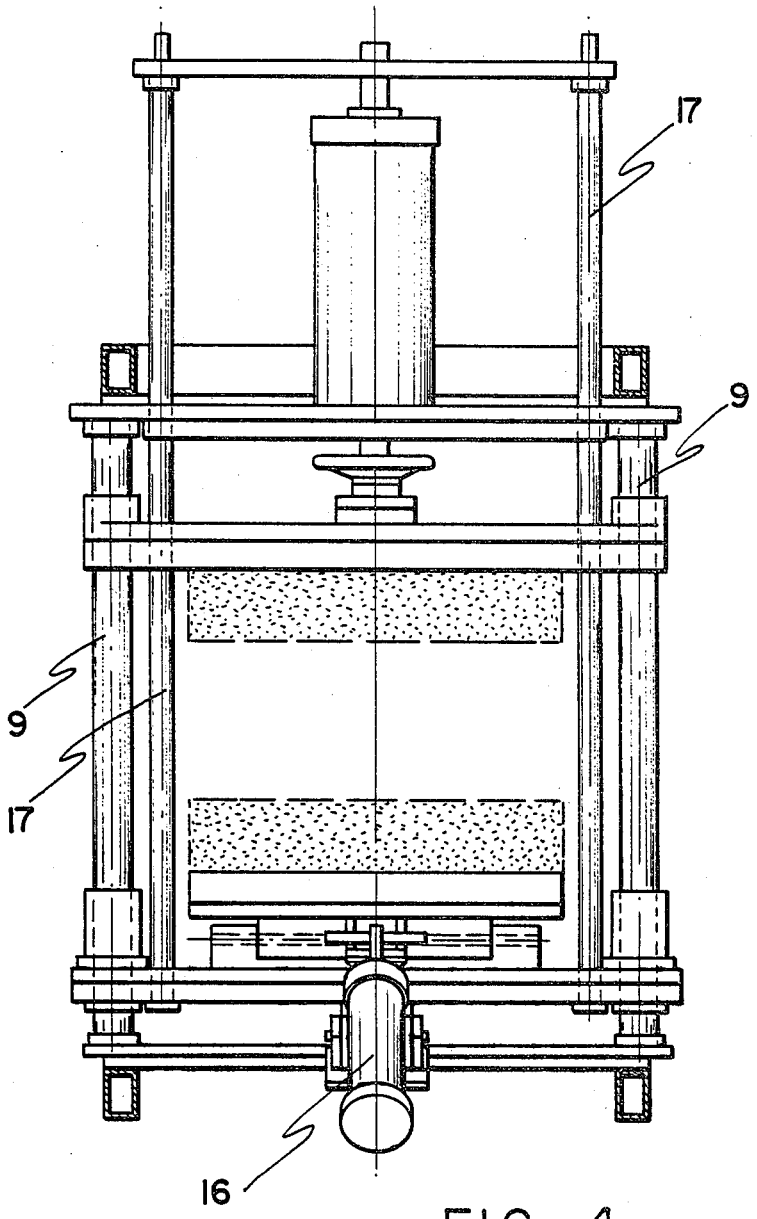
FIG. 4 is a plane section taken along line IV—IV of FIG. 3.
Figure 5:
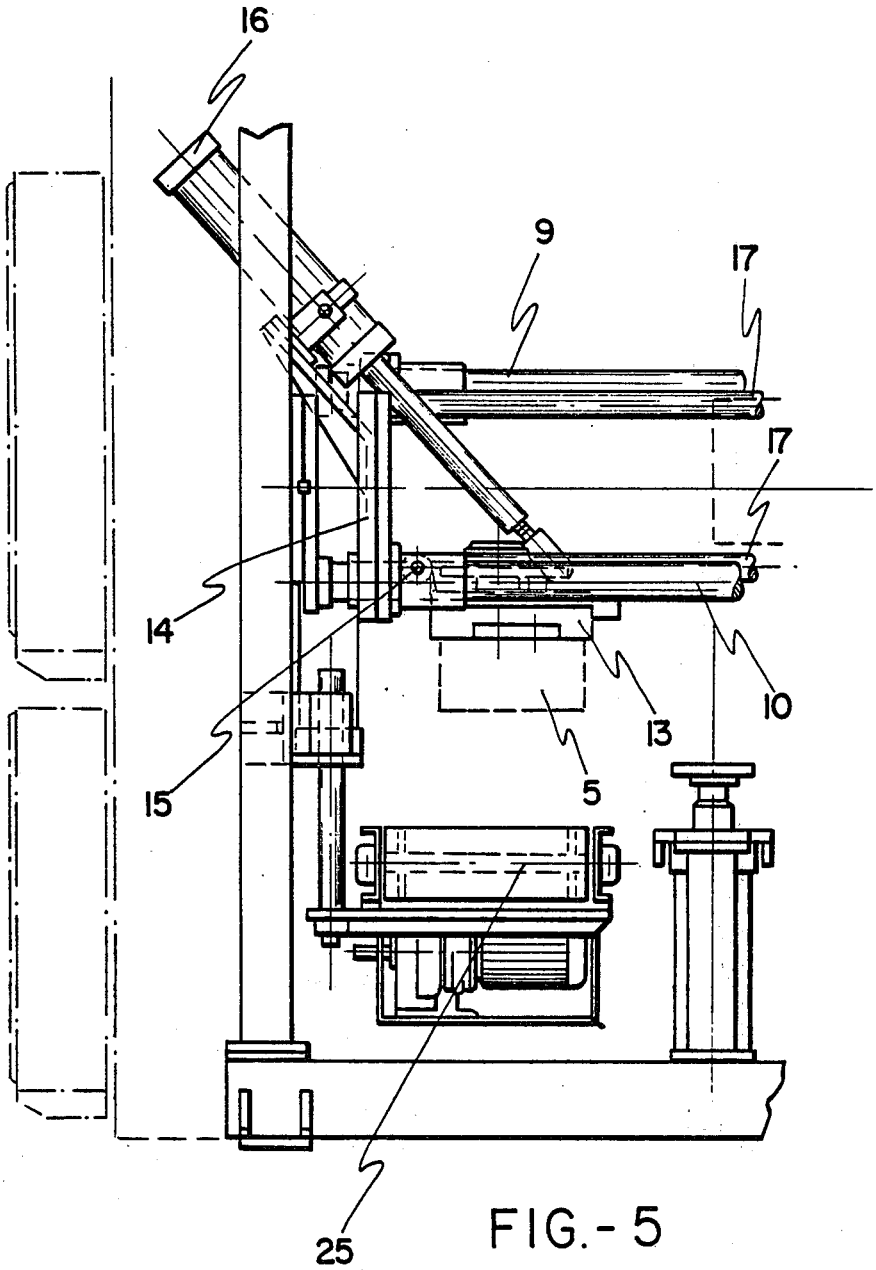
FIG. 5 is a partial enlarged elevation view which illustrates the position of one of the master plates in order to deposit the master plate on a conveyor belt.

A blowing sand molding machine according to the present invention includes a metallic main frame 1, to the upper part of which there is joined a hopper 2 in which sand is stored, which sand passes in a dosed manner to a blowing cartridge 3 when such cartridge, on being displaced in one direction, is situated in vertical alignment with the hopper 2. When the blowing cartridge 3 is displaced in an opposite direction, it faces master plates 5 and 6 to transfer the sand thereto, which sand is driven by a current of pressurized air blown in the interior of the cartridge 3 by means of a device 4.

The master plates 5 and 6 are fixed by means of supports 7 and 8 which are guided on a pair of cylindrical bars 9 and 10 hanging horizontally from below the blowing cartridge 3 and at opposite sides of the frame 1.

The cylindrical bar 10 is at the front of the machine and it is situated in a plane lower than that occupied by the other bar 9, wherefor bar 10 will not constitute an obstacle for the operator.

The support 8 for the master plate 6 is displaced along the bars 9 and 10 by means of a manually operated wheel 11, while the support 7 for the master plate 5 is displaced by means of a pressure cylinder 12.

The support 7 is constituted of two halves or members 13 and 14, the rear member 14 being guided on the bars 9 and 10, and the front member 13 being hinged at 15 to the rear member 14. Front member 13 is joined to the stem of a pressure cylinder 16 arranged obliquely with respect to the direction of movement of the support 7.

The rear member 14 of support 7 is joined to two forwardly extending rods 17 which slide closely adjacent to and parallel with the bars 9 and 10, the other forward ends of such rods 17 being joined to a plate 18 to which the stem 19 of the pressure cylinder 12 is fixed.

Between the blowing cartridge 3 and the master plates 5 and 6 there is placed a gassing plate 20 which is supported by a series of bent arms 21, the upper ends of which are provided with respective wheels 22 which slide along rails 23 driven by a pressure cylinder 24.

Figure 6:
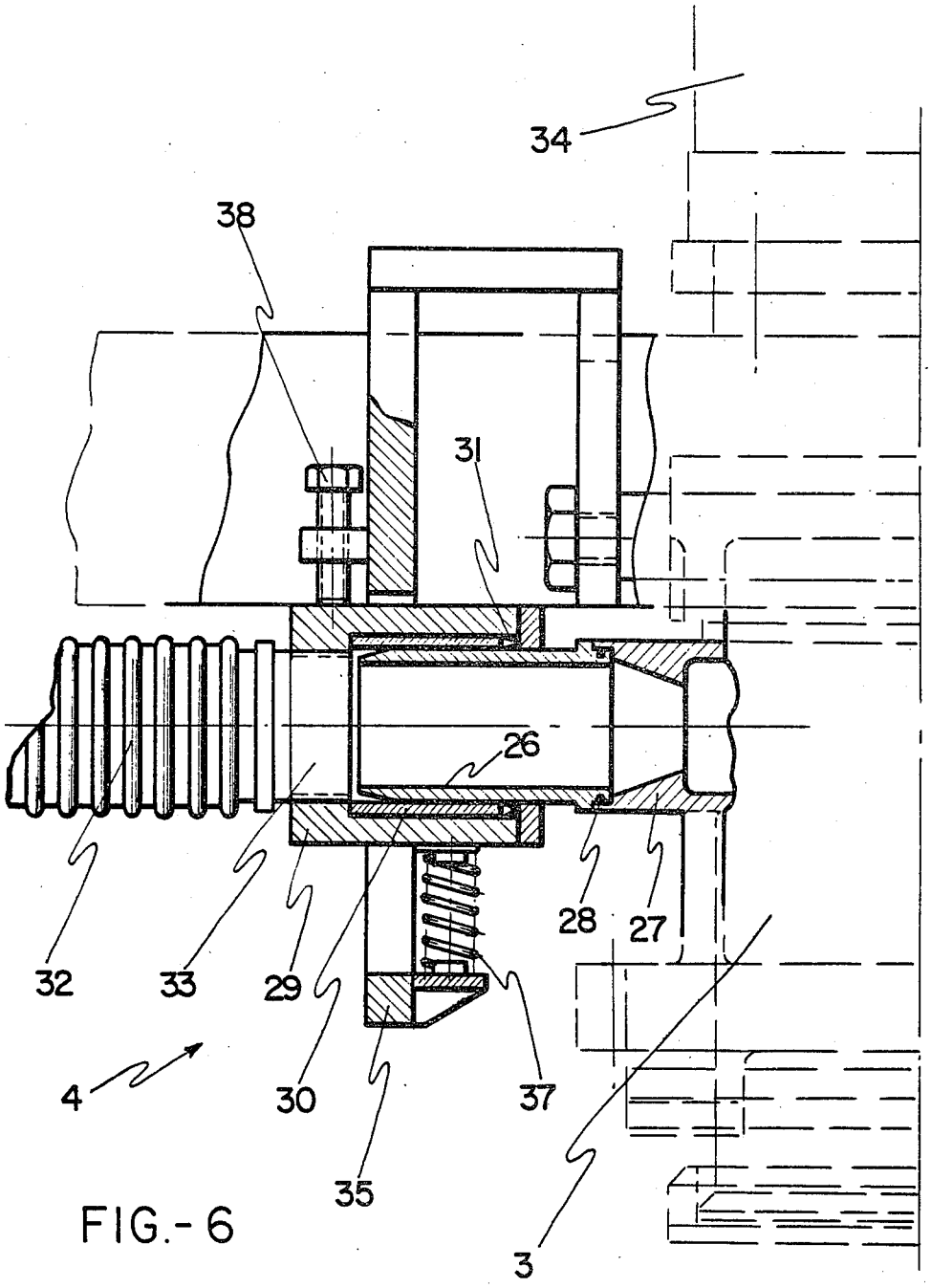
FIG. 6 is an enlarged sectional view of a coupling device between a pressurized air duct and a blowing cartridge.
Figure 7:
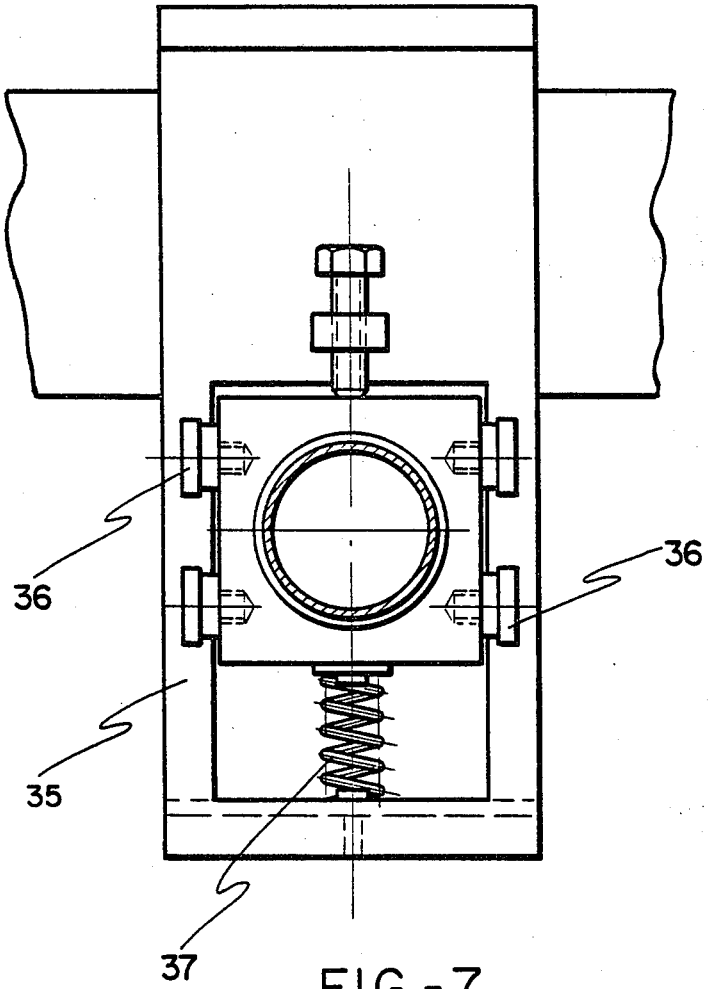
FIG. 7 is a side view of such device.

The device 4 which supplies pressurized air to the interior of the blowing cartridge 3 is illustrated in FIGS. 6 and 7 and includes a nozzle 26 joined by any means to the mouth 27 of the blowing cartridge 3. A flexible joint 28 is used for this joining to achieve a perfect seal.

The nozzle 26 is so sized that it penetrates a block member 29, the inside of which is provided with a cap 30 and a tight joint 31. Thus, the blowing cartridge 3 is tightly coupled to a pressurized air duct 32 which is joined to an orifice 33 made for such purpose in the member 29.

The member 29 is vertically displaceable in a support 35. Therefore, the sides of the support 35 (see FIG. 7) form roller guides for the sliding of rollers 36 mounted laterally on member 29. The pressurized air duct 32 does not prevent the vertical displacement of the member 29 since duct 32 is flexible, i.e. it is made from rubber or any other similar material.

The assembly of the described device includes the arrangement of a screw 38 which is used to adjust the height of the correct position of the member 29.

When the blowing cartridge 3, filed with sand, has been withdrawn from the hopper 2 and occupies the appropriate position in the machine, the support 8 of the master plate 6 is brought nearer by driving the wheel 11. The support 7 of the master plate 5 is displaced, moved by the rods 17 which control the stem 19 of cylinder 12.

Therefore, supports 7 and 8 are guided on the bars 9 and 10 and position the master plates 5 and 6 in a closed position defining a mold cavity below the discharge mouth of the blowing cartridge 3, whereat the master plates receive the sand container in the blowing cartridge with the help of the pressurized air supplied by the device 4.

The pressurized air duct 32 is connected to the blowing cartridge 3 when the nozzle 26 penetrates into the member 29, being in the position illustrated in FIG. 6. Then the blowing cartridge is moved downwardly by a pressure cylinder 34 until it is tightly coupled to the inlet of a core box formed by plates 5 and 6.

When blowing has taken place, the cartridge 3 again is positioned below the hopper 2 to collect a new load of sand. At this moment the nozzle 26 becomes disconnected from the member 29 which again occupies its highest position due to the recovery of a helical spring 37 which was heretofore compressed. One of the ends of the spring 37 rests on a lug incorporated in the support 35, while the other end of spring 37 rests directly on the member 29.

Once these operations have been carried out, the cylinder 24 acts to situate the gassing plate 20 between the master plates 5 and 6 and the blowing cartridge 3 for gassing the sand contained in plates 5 and 6.

When molding has terminated, the cylinder 12 displaces the support 7 in an opposite direction to an open position, the master plate 5 bearing the recently obtained mould. At this precise moment the cylinder 16 causes the front member 13 of support 7 to pivot at 15 in order to deposite the mould on a conveyor belt 25.

I claim:

1. A blowing sand molding machine comprising:

a main frame having mounted on an upper portion thereof a hopper for storing sand to be molded;

support means mounted on said main frame and consisting essentially of first and second parallel guide bars extending along a front portion and a rear portion, respectively, of said main frame, said first guide bar being positioned at a level substantially lower than said second guide bar;

master plates mounted on said guide bars for movement along said guide bars between a closed position whereat said master plates define a mold cavity and an open position;

a blower cartridge mounted on said main frame for movement between a first position beneath said hopper to receive therefrom a charge of sand to a second position above said mold cavity when said master plates are in said closed position;

means for directing automatically pressurized gas into said blower cartridge when said blower cartridge is in said second position thereof, and thereby for blowing the charge of sand in said blower cartridge into said mold cavity, said directing and blowing means comprising a nozzle extending horizontally from said blower cartridge and communicating with the interior thereof, a flexible duct adapted to be connected to a source of pressurized gas, and a block member permanently connected to said flexible duct and having defined therein a horizontally extending orifice, said block member being mounted on said main frame at a position such that when said blower cartridge moves to said second position thereof said nozzle of said blower cartridge simultaneously automatically is inserted into said orifice in said block member; and means for mounting said block member at said position thereof for vertical displacement with said blower cartridge, said mounting means comprising a support fixed to said main frame and including vertical guides, said block member having rollers mounted for movement in said vertical guides, spring means mounted on said support and acting on said block member for urging said block member upwardly along said guides, and abutment means mounted on said support at a position to be abutted by said block member under the spring force of said spring means, the vertical position of said abutment means being adjustable.

2. A machine as claimed in claim 1 wherein within said orifice in said block member are positioned cap and elastic joint means for forming a tight coupling of said nozzle to said block member.

* * * * *